US008454400B1

(12) United States Patent
Downs, Jr.

(10) Patent No.: US 8,454,400 B1
(45) Date of Patent: Jun. 4, 2013

(54) OUTBOARD MOTOR COMPRESSION TRANSOM ATTACHMENT ASSEMBLY

(75) Inventor: Edward F. Downs, Jr., Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 150 days.

(21) Appl. No.: 13/199,514

(22) Filed: Jul. 22, 2011

(51) Int. Cl.
*B63H 1/14* (2006.01)
*F16M 1/00* (2006.01)

(52) U.S. Cl.
USPC ..... 440/49; 248/642

(58) Field of Classification Search
USPC ..... 440/49, 63; 248/640–643
See application file for complete search history.

(56) References Cited

U.S. PATENT DOCUMENTS 2,928,630 A * 3/1960 Wisman ..... 248/641
3,304,720 A * 2/1967 Craig ..... 60/222
7,510,450 B1 * 3/2009 Dresher ..... 440/63

* cited by examiner

*Primary Examiner* — Stephen Avila
(74) *Attorney, Agent, or Firm* — James T. Shepherd

(57) ABSTRACT

An attachment assembly quickly and securely mounts an outboard motor on a boat transom. Side frame members are disposed in a laterally spaced-apart relationship by two interconnected lateral frame members. A laterally extending cam member is rotatably connected to the side frame members and laterally extends the length between the side frame members. A cam rotating mechanism is connected to the cam member to selectively impart its rotational displacement and a lateral inverted-U-shaped transom channel is formed in the side frame members and is disposed adjacent to the cam member. The rotational displacement of the cam member effects an outward displacement of an outer surface of the cam member into the inverted-U-shaped transom channel to compressively engage and secure a transom by the cam member across the entire width of the motor.

12 Claims, 5 Drawing Sheets

OUTBOARD MOTOR COMPRESSION TRANSOM ATTACHMENT ASSEMBLY

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

This invention relates to an assembly for mounting an outboard motor on the transom of a boat. More particularly, the invention is for an attachment assembly for quickly and securely attaching an outboard motor on an inflatable or standard boat transom by a single operator without requiring additional personnel to vertically position and lower the motor during its attachment procedure.

Currently, smaller commercial outboard motors are attached to the transom of a boat by tightening two large threaded rods located on the swivel bracket of the outboard motor. These rods are screwed in to serve as clamps that engage the transom. In order for this interconnection to occur, the motor must first be held in a vertical position directly above the boat transom, and then the motor is lowered onto the transom. Depending on the size of the motor, this procedure requires at least two or three very physically capable assistants. Next, the threaded rods are rotated or screwed inwardly to tighten the end plates located on the ends of the rods against the boat transom. However, since these end plates usually are not designed to be tightened and loosened repeatedly, they often separate or otherwise fail and, consequently, the motor cannot be securely attached to the transom.

Thus, in accordance with this inventive concept, a need has been recognized in the state of the art for an attachment assembly for quickly and securely attaching an outboard motor on a boat transom.

SUMMARY OF THE INVENTION

The present invention provides an attachment assembly for mounting an outboard motor on a boat transom. Side frame members are disposed in a laterally spaced-apart relationship and at least one lateral frame member is each connected to both of the side frame members to create the dimensions of the laterally spaced-apart relationship. A laterally extending cam member extends between the side frame members and is rotatably connected at opposite ends to the side frame members. An aligned bore is formed in each of the laterally spaced-apart side frame members. Cylindrically-shaped protrusions located on opposite ends of the laterally extending cam member are aligned with each other and are sized to each fit within a separate aligned bore of the side frame members for rotation, and a cam rotating mechanism is connected to the cam member to selectively impart rotational displacement of the protrusions in the aligned bores. A lateral inverted-U-shaped transom channel is formed in and between the side frame members and is disposed adjacent to the cam member. The cam member is integrally connected to receive the selectively imparted rotational displacement of the protrusions by the cam rotating mechanism to effect rotation of the cam member. This rotation of the cam member effects an extension of a laterally extending outer surface of the cam member into the inverted-U-shaped transom channel to compressively engage a transom by the cam member.

An object of the invention is to provide an attachment assembly to securely attach an outboard motor onto a boat transom.

An object of the invention is to provide an attachment assembly that quickly and securely attaches an outboard motor onto a boat transom by a single operator.

Another object of the invention is to provide an attachment assembly having a single laterally extending cam member to mount and secure an outboard motor on a boat transom.

Another object of the invention is to provide an attachment assembly having a single rotatable laterally extending cam member to laterally compressively engage a boat transom and secure an outboard motor thereon.

Another object of the invention is to provide an attachment assembly having a single rotatable cam disposed to extend laterally across the front of an outboard motor for quickly and reliably engaging a boat transom.

Another object of the invention is to provide an apparatus having a single rotatable cam extending laterally across the front of an outboard motor and being actuated by a single operator to quickly and reliably engage a boat transom.

These and other objects of the invention will become more readily apparent from the ensuing specification when taken in conjunction with the appended claims.

DESCRIPTION OF THE PREFERRED EMBODIMENT

Figure 1:
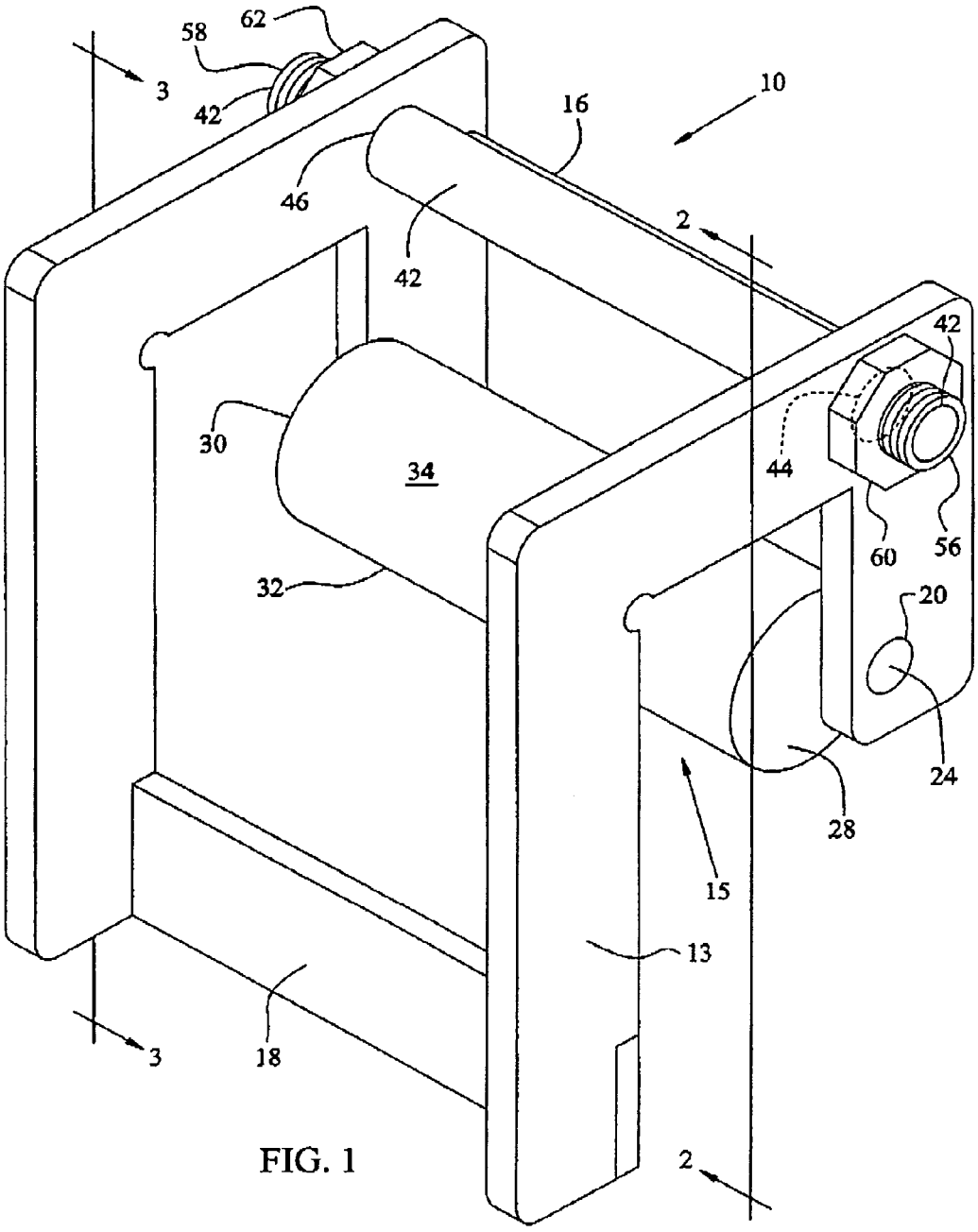
FIG. 1 is an isometric view of the outboard motor attachment assembly of the invention.

Referring to FIG. 1, an outboard motor attachment assembly 10 of the invention allows a single operator to securely attach an outboard motor onto a transom of a small conventional or inflatable boat. Attachment assembly 10 is specifically designed as herein described to also assure a greater degree of reliability as compared to conventional screw-type mounting mechanisms found on most outboard motors.

Figure 2:
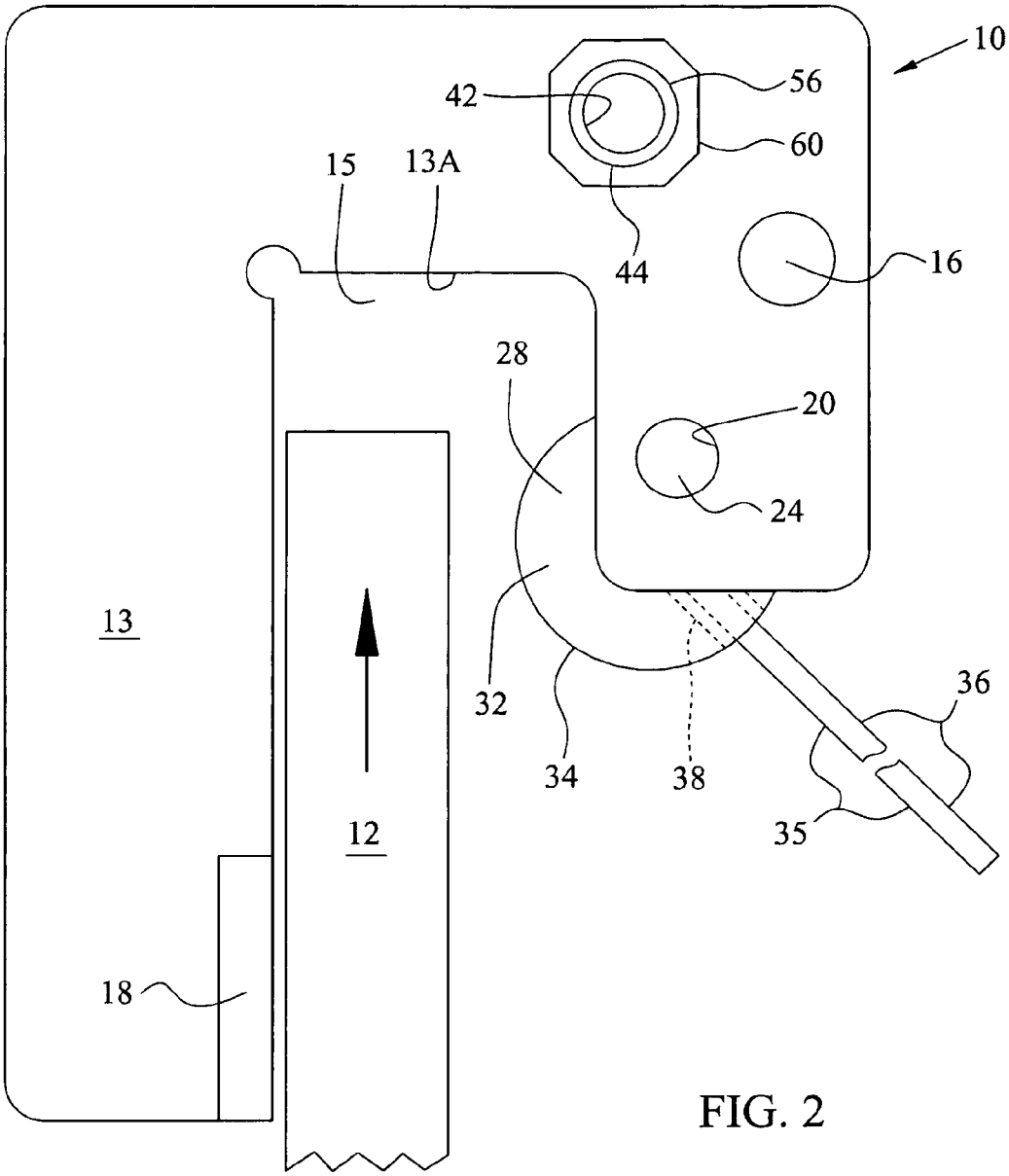
FIG. 2 is a side view of the outboard motor attachment assembly taken along line 2-2 in FIG. 1 showing its laterally extending cam member disengaged from a boat transom.
Figure 3:
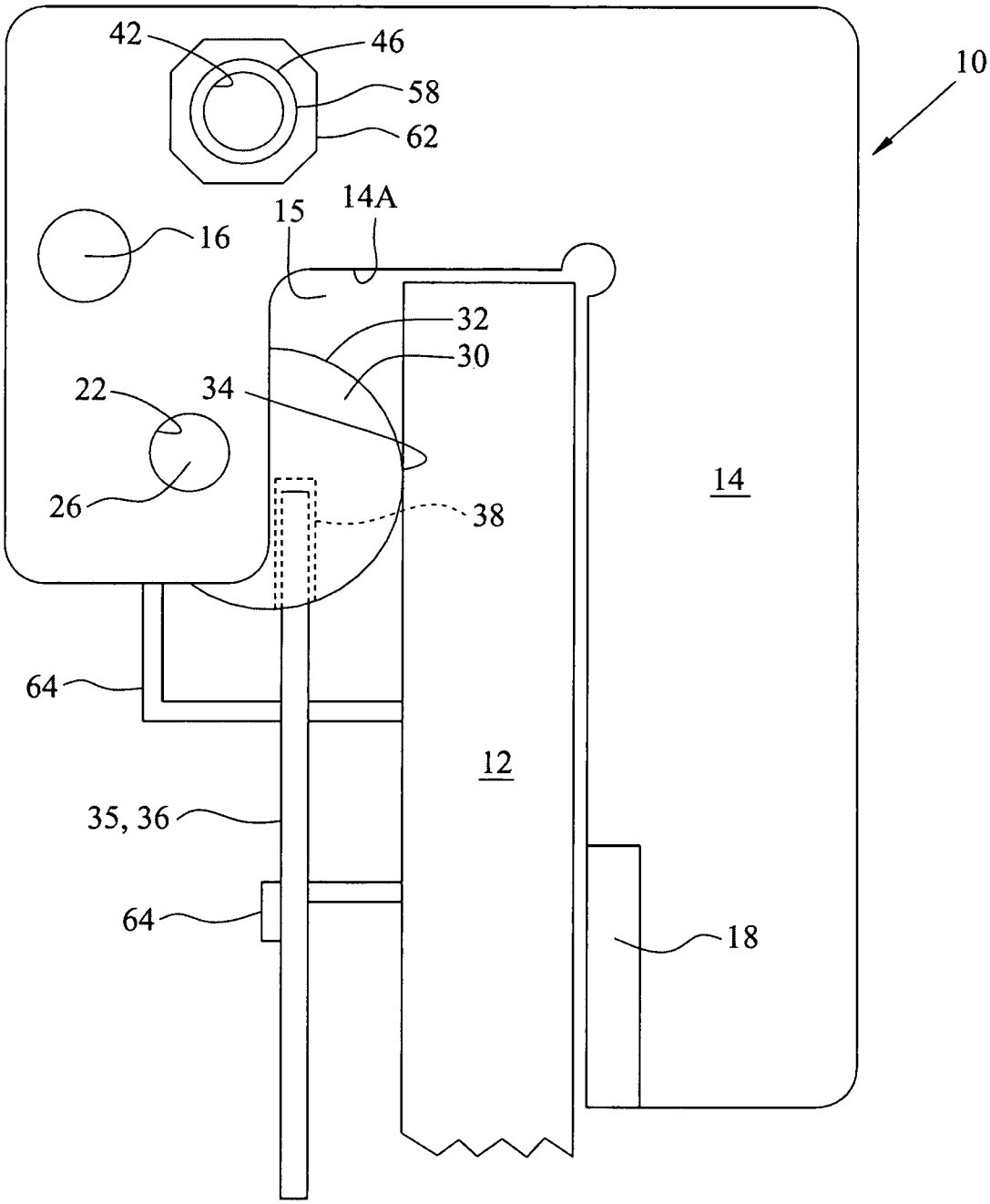
FIG. 3 is a side view of the outboard motor attachment assembly taken along line 3-3 in FIG. 1 showing its laterally extending cam member compressively engaging a boat transom.

Referring also to FIGS. 2 and 3, attachment assembly 10 has a pair of spaced-apart side frame members 13 and 14 that are shaped to define a laterally-extending inverted-U-shaped channel 15 sized to receive transom 12 of a small conventional or inflatable boat. This inverted-U-shaped channel should be visualized to be formed in the side frame members 13 and 14, and laterally extend across the space between the side frame members. Side frame members 13 and 14 are secured to and held in a laterally spaced-apart relationship by two lateral frame members 16 and 18. The use of two lateral frame members is shown as the preferred embodiment; however, a single lateral frame member or more than two may be used in alternate embodiments without departing from the scope of the invention. The side and lateral frame members and other parts of attachment assembly 10 to be described are preferably made from suitably dimensioned rugged metal stock such as steel, stainless steel, etc. and are welded, bolted, and/or otherwise suitably secured together. However, the materials selected and manner of assembly are not limitations of the invention.

Side frame members 13 and 14 of attachment assembly 10 each have a separate bore 20 and 22, respectively. Bores 20 and 22 are laterally aligned with each other and are sized to each respectively receive a slightly smaller cylindrically-shaped protrusion 24 and 26 located on opposite ends 28 and 30 of a laterally extending cylindrically-shaped cam member 32 adjacent to transom channel 15. Cylindrically-shaped protrusions 24 and 26 are axially aligned with each other and can be machined from the stock on opposite ends 28 and 30 of cam member 32. Optionally, machinists can provide cam member 32 with a bore (not shown) extending its length that contains an elongate shaft (not shown) that projects the axially aligned protrusions 24 and 26 outwardly at opposite ends 28 and 30 of cam member 32. In addition, cam member 32 could have other cross-sectional shapes other than the disclosed round shape. For example, elliptical, tear-drop or a wide variety of other shapes might be used.

The protrusions 24 and 26 are slightly smaller than bores 20 and 22, and are thus free to rotate in bores 20 and 22. The protrusions 24 and 26 are not coaxially located with respect to the central axis of cam member 32. Instead, they are located radially outwardly toward the circumference of cam member 32. Thus, rotational displacement of cam member 32 about the axis defined by protrusions 24 and 26 imparts a selective outward or inward rotational motion, or displacement of the level of outer surface 34 of cam member 32 in and out of transom channel 15. This displacement of outer surface 34 of cam member 32 in transom channel 15 can be selectively imparted by an operator rotating cam member 32 by a cam rotating mechanism 35. The cam rotating mechanism 35 can be, for example, a metal rod 36 inserted into a bore 38 in cam member 32.

Figure 4:
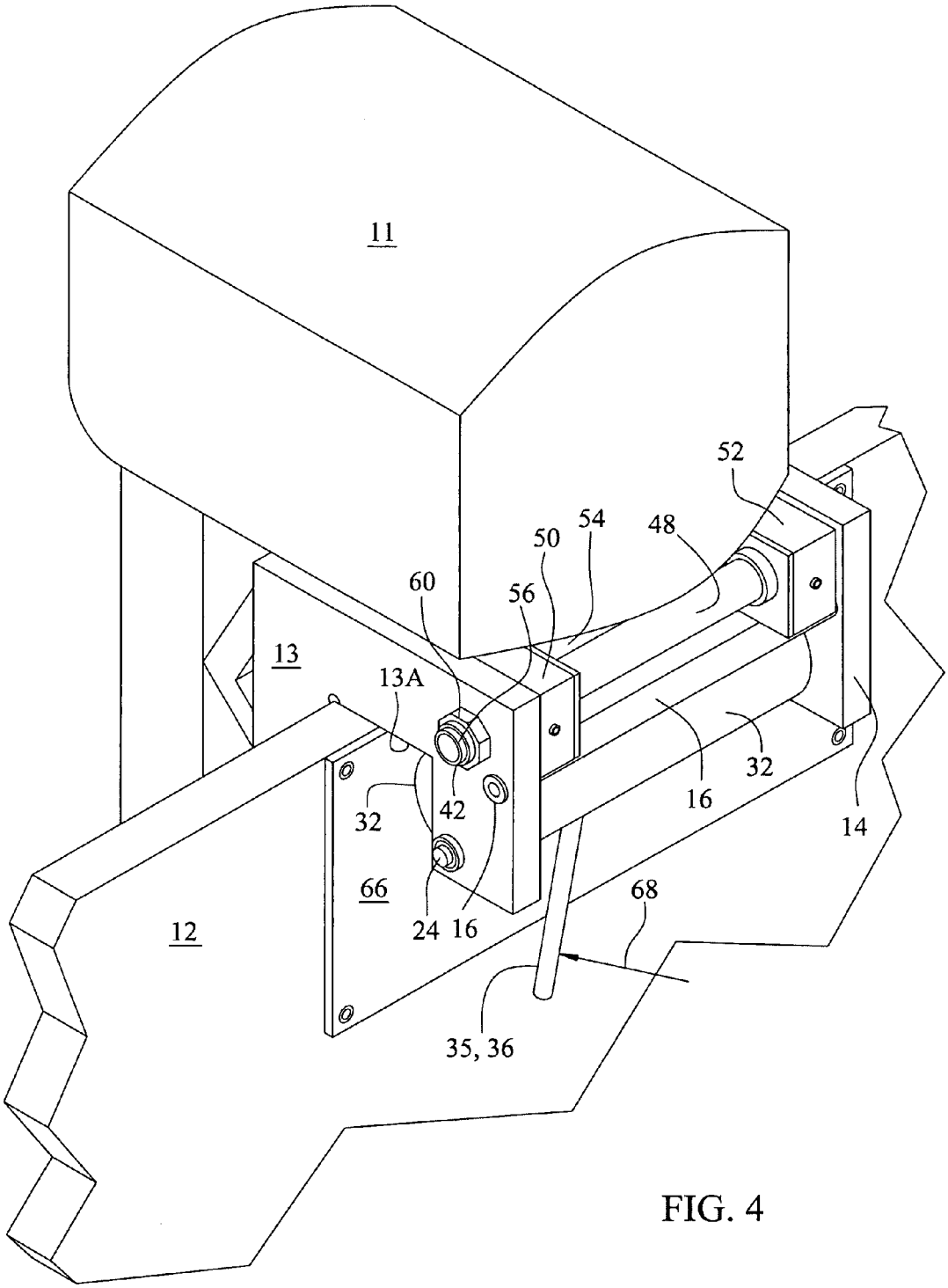
FIG. 4 is an isometric side view of the outboard motor attachment assembly of the invention mounted on a boat transom.
Figure 5:
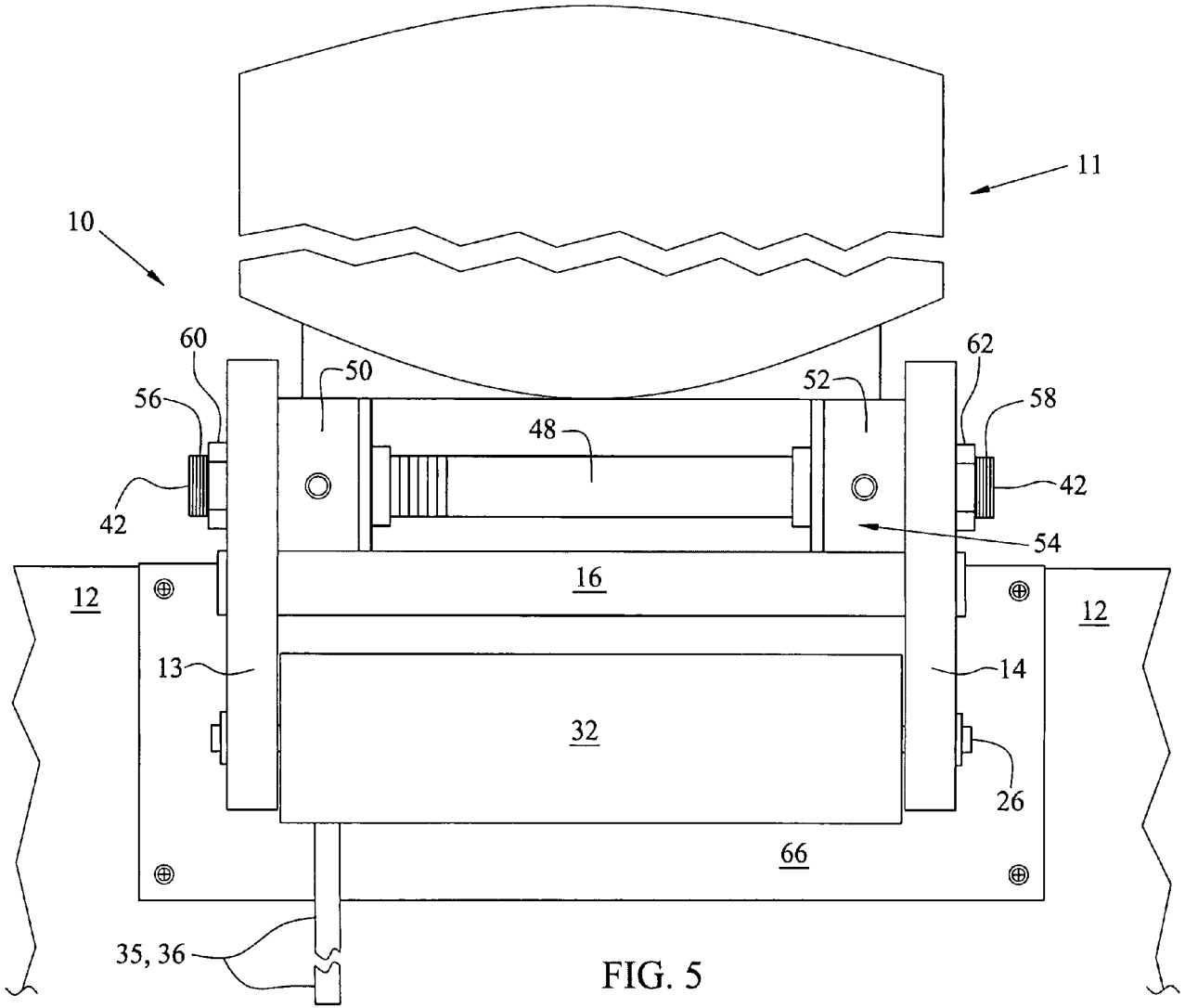
FIG. 5 is a front view of the outboard motor attachment assembly showing the cam member laterally extending and compressively engaging the transom across the width of the outboard motor.

Referring also to FIGS. 4 and 5, attachment assembly 10 has a lateral shaft 42 that extends through a pair of aligned bores 44 and 46 in side frame members 13 and 14. Lateral shaft 42 extends through a tilt tube 48 extending across the front of outboard motor 11 between a pair of apertured fittings 50 and 52 of a swivel bracket 54 of outboard motor 11. Lateral shaft 42 has threaded portions 56 and 58 on opposite ends where it reaches through bores 44 and 46 of side frame members 13 and 14. Correspondingly threaded nuts 60 and 62 are tightened onto threaded portions 56 and 58 to securely connect lateral shaft 42 on side frame members 13 and 14. This interconnection assures the secure connection and holding of outboard motor 11 on attachment assembly 10 and onto transom 12 via attachment assembly 10. With outboard motor 11 thusly mounted on attachment assembly 10, lateral shaft 42 allows outboard motor 11 to rotate about it and rotate the propeller assembly (not shown) of motor 11 into and out of the water as needed.

Referring once again to FIG. 2, to receive a transom 12 in laterally extending inverted U-shaped transom channel 15, an operator merely rotates cam member 32 out of transom channel 15 via rod 36 of cam rotating mechanism 35 that has been inserted in transverse bore 38. Attachment assembly 10 is brought adjacent boat transom 12 and transom 12 is guided into transom channel 15 in the direction shown by the arrow. When transom 12 is fully taken into transom channel 15 and it rests against surfaces 13A and 14A of side frame members 13 and 14 as shown in FIGS. 3 and 4, the operator forcefully rotates cam member 32 with rod 36 until outer surface 34 of cam member 32 forcefully bears against the side of transom 12. This forceful, compressive engagement of transom 12 along the entire length of outer surface 34 of cam member 32 extends laterally across the entire width of outboard motor 11 to positively secure transom 12 to outboard motor 11 via attachment assembly 10. A retaining latch, anchored length of line or cable or some other suitable securing device 64 can be suitably mounted on transom 12 or on either of side frame members 13 and 14 to engage and secure rod 36 in place after it has been rotated to create the compressive engagement of transom 12 (see FIG. 3).

Rotating and securing cam member 32 against transom 12 can be accomplished by other means than described above regarding rod 36 of cam rotational mechanism 35. A ratcheting gear and socket arrangement much like that used in a well known ratcheting socket wrench can engage a mating recess or appropriately shaped nut structure on protrusions 24 and/or 26 of cam member 32. Tightening by this arrangement can be performed by repeatedly displacing the pivot bar back and forth to rotate cam member 32 and displace outer surface 34 of cam member 32 in a compressive engagement of transom 12. Release of transom 12 is done by merely moving a small lever of the ratchet mechanism to relieve the compressive force that had been earlier created. Other mechanisms including Allen-wrench or open-ended wrenches for selectively creating enough compressive force by cam member 32 and securing it in place will readily suggest themselves to one skilled in the art to which this invention pertains. Irrespective of what mechanism is selected, the positive compressive engagement of transom 12 by cam member 32 can be so strong as to possibly damage the material of transom 12, which is often made of wood on typical small boats. Referring to FIGS. 4 and 5, a protective metal bearing-plate structure 66 may be mounted on transom 12 to protect the transom and avoid this possibility.

When attachment assembly 10 of the invention is rotatably mounted to swivel bracket 54 of an outboard motor 11 as described above, a single operator can attach an outboard motor to the transom 12 of a conventional or inflatable boat. The engine can be placed in the bottom of the boat with the lower portion including the propeller assembly lying near the stern. The lower part of the engine can be lifted up on the top of the transom with the propeller shaft extending outboard so that the rest of the engine can be pushed along over the transom in the outboard direction. The attachment assembly 10 is slid in the outboard direction until it is placed adjacent transom 12. Since attachment assembly 10 is rotatably mounted onto outboard motor 11 via lateral shaft 42 extending through swivel bracket 54, it is simply pushed or slid over transom 12 until transom channel 15 of attachment assembly 10 is placed adjacent transom 12. At this point, attachment assembly 10 starts to receive transom 12 in channel 15 by rotating sufficiently about its lateral shaft 42 to fit side frame members 13 and 14 bordering U-shaped channel 15 down and about transom 12 as it continues to fall onto transom 12. When the top of transom 12 abuts surfaces 13A and 14A of side frame members 13 and 14, see FIGS. 3 and 4, an operator need only forcefully rotate rod 36 (as shown by arrow 68) to compressively engage transom 12 by cam member 32. Then, the operator secures rod 36 in place by appropriate actuation of suitable securing device 64.

One skilled in the art to which this invention pertains can modify the teachings of attachment assembly 10 within the purview of ordinary skill. Having these teachings, one can modify and reorient the side and lateral frame members to locate the cam member to vertically extend and compressively engage the transom to secure the motor on the transom. In this case the cam rotation mechanism would also be differently oriented to be horizontally rotated to effect this engagement. In addition this modified arrangement might be further modified to effect positive, extended compressive engagement of the transom by using two of the vertically extending cam members as herein described in place of the thumb screws of the conventional prior art thumb-screw designs described above.

It should be readily understood that many modifications and variations of the present invention are possible within the purview of the claimed invention. It is to be understood that within the scope of the appended claims the invention may be practiced otherwise than as specifically described.

I claim:

1. An attachment assembly for mounting an outboard motor on a boat transom comprising:

a pair of U-shaped side frame members disposed in a laterally spaced-apart relationship, said side frame members forming a lateral inverted-U-shaped transom channel extending therebetween, each of said side frame members having a first bore laterally aligned with a corresponding first bore in the other said side frame member;

at least one lateral frame member having opposite ends, each end coupled to a different one of said side frame members to create said laterally spaced-apart relationship;

a cylindrical cam member having an outer surface, a central axis, and axially aligned cylindrical protrusions extending from opposite ends thereof at a position radially offset from said central axis, each of said protrusions being inserted into a corresponding one of said first bores, thereby rotatably coupling said cam member to said side frame members;

wherein said cam member is sized and positioned so that said outer surface abuts and compressively engages a boat transom positioned within said transom channel when said cam member is rotated in a first direction, and said cam member is drawn away from and releases the boat transom when said cam member is rotated in a second direction.

2. The attachment assembly of claim 1, further comprising means for rotating said cam member.

3. The attachment assembly of claim 2, wherein said means for rotating comprises a rod coupled to said cam member.

4. The attachment assembly of claim 3, further comprising a latch positioned to secure said rod in place when said cam member is rotated in said first direction.

5. The attachment assembly of claim 1, further comprising means for mounting an outboard motor to said assembly.

6. The attachment assembly of claim 5, wherein said means for mounting comprises a lateral shaft extending between and removably coupled to said side frame members proximate to upper ends thereof, said lateral shaft being positioned and sized to extend through a tilt tube and fittings in a swivel bracket on the outboard motor.

7. The attachment assembly of claim 6, wherein said side frame members have second bores aligned axially with each other, said lateral shaft has threaded ends, said threaded ends pass through said second bores, and said assembly further comprises threaded nuts sized to accept said threaded ends and operable to secure said lateral shaft to said side frame members.

8. A quick-connect outboard motor assembly for mounting on a boat transom comprising:

a pair of U-shaped side frame members disposed in a laterally spaced-apart relationship, said side frame members forming a lateral inverted-U-shaped transom channel extending therebetween, each of said side frame members having a first bore laterally aligned with a corresponding first bore in the other said side frame member;

at least one lateral frame member having opposite ends, each end coupled to a different one of said side frame members to create said laterally spaced-apart relationship;

a marine outboard motor;

a swivel bracket coupled to said outboard motor, said swivel bracket having fittings on opposite sides of said swivel bracket and a tilt tube disposed therebetween;

a lateral shaft extending between and removably coupled to said side frame members proximate to upper ends thereof, said lateral shaft extending through said tilt tube and said fittings;

a cylindrical cam member having an outer surface, a central axis, and axially aligned cylindrical protrusions extending from opposite ends thereof at a position radially offset from said central axis, each of said protrusions being inserted into a corresponding one of said first bores, thereby rotatably coupling said cam member to said side frame members;

wherein said cam member is sized and positioned so that said outer surface abuts and compressively engages a boat transom positioned within said transom channel when said cam member is rotated in a first direction, and said cam member is drawn away from and releases the boat transom when said cam member is rotated in a second direction.

9. The attachment assembly of claim 8, further comprising means for rotating said cam member.

10. The attachment assembly of claim 9, wherein said means for rotating comprises a rod coupled to said cam member.

11. The attachment assembly of claim 10, further comprising a latch positioned to secure said rod in place when said cam member is rotated in said first direction.

12. The attachment assembly of claim 8, wherein said side frame members have second bores aligned axially with each other, said lateral shaft has threaded ends, said threaded ends pass through said second bores, and said assembly further comprises threaded nuts sized to accept said threaded ends and operable to secure said lateral shaft to said side frame members.

* * * * *